US006671913B2

(12) United States Patent
Wozniak

(10) Patent No.: US 6,671,913 B2
(45) Date of Patent: Jan. 6, 2004

(54) SPECIALIZED MILITARY AND POLICE COMBINATION TOOL

(76) Inventor: Martin J. Wozniak, 5400 E. Yacht Dr.-Suite D7, Oak Island, NC (US) 28465

( * ) Notice: Subject to any disclaimer, the term of this patent is extended or adjusted under 35 U.S.C. 154(b) by 0 days.

(21) Appl. No.: 09/798,265

(22) Filed: Mar. 2, 2001

(65) Prior Publication Data

US 2002/0120987 A1 Sep. 5, 2002

(51) Int. Cl.[7] ..... B25B 13/00

(52) U.S. Cl. ..... 7/138; 7/145; 7/146; 7/166; 81/177.2

(58) Field of Search ..... 7/138, 145, 146, 7/166; 81/177.1, 489, 177.2

(56) References Cited

U.S. PATENT DOCUMENTS

| | | | | |
|---|---|---|---|---|
| 576,756 A | | 2/1897 | Cole | |
| 1,875,612 A | | 9/1932 | Johnson | |
| 3,219,316 A | | 11/1965 | Fried | 254/131 |
| 3,599,255 A | | 8/1971 | Carroll, Sr. | 7/8.1 R |
| 3,604,028 A | | 9/1971 | Wardwell | 7/8.1 |
| 3,623,173 A | | 11/1971 | Hagqvist | 7/8.1 |
| 3,837,023 A | | 9/1974 | Spencer-Foote | 7/8.1 R |
| 4,023,221 A | | 5/1977 | Cadman | 7/1 R |
| 4,114,216 A | | 9/1978 | Gatby | 7/116 |
| 4,287,623 A | | 9/1981 | Tarran | 7/158 |
| 4,685,213 A | | 8/1987 | Powers | 30/123 |
| 4,700,420 A | | 10/1987 | Belanger | 7/114 |
| 4,829,857 A | * | 5/1989 | Jones | 81/177.1 |
| 4,958,395 A | | 9/1990 | Busskohl | 7/145 |
| 4,972,733 A | * | 11/1990 | Olmr et al. | 81/177.1 |
| 5,044,033 A | | 9/1991 | Fosberg | 7/166 |
| 5,105,493 A | | 4/1992 | Lugtenaar | 7/116 |
| 5,315,724 A | | 5/1994 | Trujillo et al. | 7/145 |
| 5,428,853 A | | 7/1995 | Menke et al. | 7/138 |
| 5,829,082 A | * | 11/1998 | Moreira | 81/489 |
| 5,911,798 A | * | 6/1999 | Arnold | 81/177.1 X |

* cited by examiner

*Primary Examiner*—James G. Smith
(74) *Attorney, Agent, or Firm*—Michael E. Mauney

(57) ABSTRACT

A tool assembly for military or police uses with removable interchangeable tool heads and handles. The handles of the tool assembly have connector assemblies at each end of the handle constructed of a cast nylon material impregnated with a dry lubricant and with a dimpled pin connector in the connector assemblies. Each tool head has a bore for receipt of the connector assembly and pin connector. The connector assemblies are constructed of a non-conductive, non-sparking material and the bores on the tool heads for receipt of the connector assemblies are made with close tolerances to provide for overall rigidity and strength of the tool assembly. The handles have a soft, non-conductive, shock absorbing outer covering. The pin connectors on the connector assemblies are oriented with the outer covering of the tool handles to facilitate ease of assembly of the tools in the dark or other adverse conditions.

11 Claims, 7 Drawing Sheets

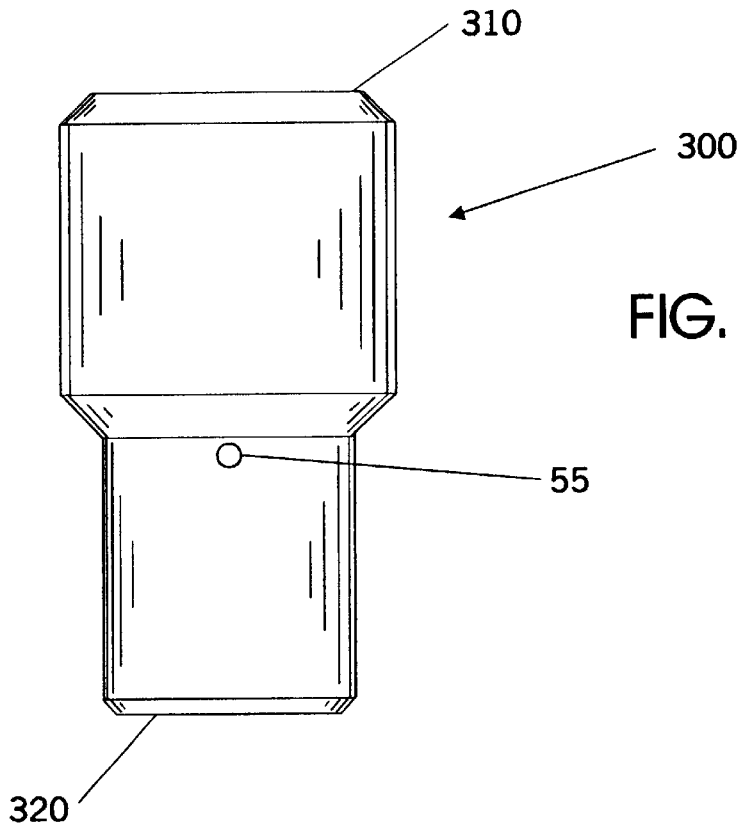
FIG. 6
FIG. 7
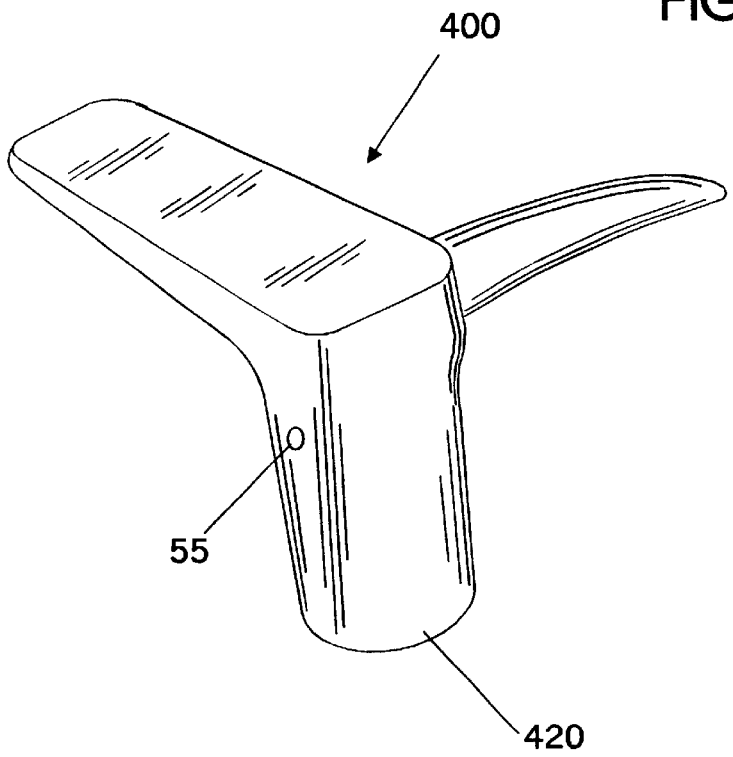

SPECIALIZED MILITARY AND POLICE COMBINATION TOOL

FIELD OF THE INVENTION

The invention relates generally to specialized tool kits that combine into a variety of tools. These tool kits are designed specifically for use by military units in hostile environments. However, it is anticipated that these tool kits may also be used by special weapons and tactics police squads, drug enforcement squads, and in other uses where there is a premium on compactness, portability, and versatility of a tool set.

BACKGROUND OF THE INVENTION

Since the break up of the old Soviet Union, the military has had to adopt to different tactical and strategic missions. For approximately 50 years, the primary strategic mission of the United States military was to respond to aggression from a large well-equipped adversary in a traditional ground war. Consequently, highly trained mechanized battalions were stationed in Europe, Korea, and other places where such an attack was viewed as possible. However, after the break up of the Soviet Union, the threat of a large scale military attack by mechanized or armored infantry units have become significantly less. Rather, the military has found itself engaged in peace-keeping functions in such places as Haiti, Somalia, and the Balkans. In these circumstances, company, platoon, or even squad size units are dispersed in an urban area stationed at check points or otherwise engaged in functions that bear more resemblance to traditional police functions rather than to traditional military tactics.

The resistance these units are apt to meet tends to be more individualized, ad hoc, and in the form of sniper attacks or fire fights than a large scale mechanized assault. Military personnel serving in this fashion are frequently dressed in body armor. Secondly, they are armed to respond to the kind of resistance they are expected to meet—that is, they will have automatic rifles, grenade launchers, shotguns, or other types of urban weapons. These units are required to respond instantly in a highly charged, volatile, and changing situation where time is at a premium. Ordinarily, these units must make do with what they have with them, because there will be little, if any, opportunity to return to a storage area or central area to retrieve tools that may be need at the scene of an action.

DESCRIPTION OF RELATED ART

Specialized combination tool sets have been designed specifically for firefighters. These combination tool sets have some of the qualities that are desirable in a tool set designed specifically for military use. Firefighters frequently have to perform a variety of tasks with tools at hand and may have little time to return to a storage area to retrieve a specialized tool. One example of a firefighters tool set is disclosed in Lugtenaar, U.S. Pat. No. 5,105,493. This patent discloses a set of fire fighting tools for use in fighting forest fires. This tool set includes a handle with a variety of heads which fit on a handle, including a shovel which can double as a scraper/raker with an ax and hoe blade. Trujillo et al., U.S. Pat. No. 5,315,724, discloses a combination fire tool set which has an ax-like head member disclosed at one end with a pipe-like member disclosed at the other end. Menke, U.S. Pat. No. 5,428,853, discloses a fireman's personal hand tool which has a spike and wrench member. It is specially designed to attach to a variety of hydrant valve shapes and sizes. These firefighter tools as described above ordinarily have handles that detach from tool sets. However, these handles may thread onto the tool set or be bolted or riveted onto the tool set as shown in Trujillo et al., U.S. Pat. No. 5,315,724.

Other types of combination tool sets are well known. A number of tools sets have been designed specifically for sportsmen or campers. For example, Cole, U.S. Pat. No. 576,756 discloses a sectional tool handle adopted for receipt of heads such as hammers, hatchets, spades, picks, and so on. Here the various heads and handles are connected by screwing them onto a threaded sleeve. The heads are interchangeable in the Cole combination tool. Fried, U.S. Pat. No. 3,219,316, discloses a forcible entry tool with detachable heads and handles that use spring-mounted pins for attaching the handles to the heads. A specialized cutting and breaking tool is shown in the Spencer-Foote, U.S. Pat. No. 3,837,023. The handle assembly is attachable to a plurality of tools which include such things as axes, picks, and pry bars. The Spencer-Foote device uses threaded connectors to attach handles to the tool heads like the ax, picks, and pry bars. Belanger, U.S. Pat. No. 4,700,420, discloses a multipurpose camping tool. Various components can be structured together to form an ax, a trenching spade, a grapple hook, a saw frame, and even a pole ladder.

Despite this earlier work, there is still need for a combination tool design to meet the specialized demands imposed upon the military by its peace-keeping and urban warfare roles or on paramilitary police units like SWAT teams and the like. This specialized tool assembly must be compact, easily packed and carried. Second, it must be durable and strong enough to carry out the functions required. Third, it must easily fit together to form the widest variety of tools. Fourth, nothing should be required to assemble or disassemble the tool set other than what would ordinarily be carried by military or police personnel. Fifth, the tool set should be made to close enough tolerances so that it will be sufficiently durable and useful but, at the same time, must easily assemble and disassemble in adverse conditions—that is, mud, dust, rust, and the like should not prevent the easy assembling and disassembling of the tool set. A tool set that meets the need for ease of assembly and disassembly in adverse conditions requires the use of appropriate materials, tolerances, and specialized design that is not simply a matter of choice. Sixth, and finally, the tool set should be designed to minimize the risk to users from electrical current or from such other risks as booby traps, flammable, or explosive gases.

SUMMARY OF THE INVENTION

This invention is a tool assembly. First, there should be handle pieces constructed of a lightweight, durable, and very strong material. Ordinarily, some type of plastic material is required. This handle should have specialized means for connection at each end, both to tool heads, to other handles, or to hand grips. In some circumstances, a long handle is required for a tool. Each handle piece should be capable of assembly into a longer handle by melding one or more handle pieces together. The handle material should be non-conductive and non-sparking and should help eliminate or dampen shocks transmitted through a tool head through a handle to a hand or arm of a user. There must be a variety of tool heads that are designed for quick, secure attachment and removal from the handle. The attachment and removal from the handle should be possible in adverse conditions, even when the handle or tool head is soiled, wet, or muddy. Tool heads should be designed for a variety of functions, such as lock picking or breaking, mauls to shatter door handles and doors, pikes for punching and tearing, shovels for digging, axes for cutting, and so on. The tool heads should be made of dense strong material. For some applications, the material should be non-sparking and non-conductive. The handle and heads should be designed to fit within a carrying pack so that two or three packs would provide a wide variety of possible assemblages of tools that may be needed for various functions.

BRIEF DESCRIPTION OF THE DRAWINGS

FIG. 6 shows a sledge end.

FIG. 7 shows a hallagan spike.

DETAILED DESCRIPTION OF THE DRAWINGS

Figure 1:
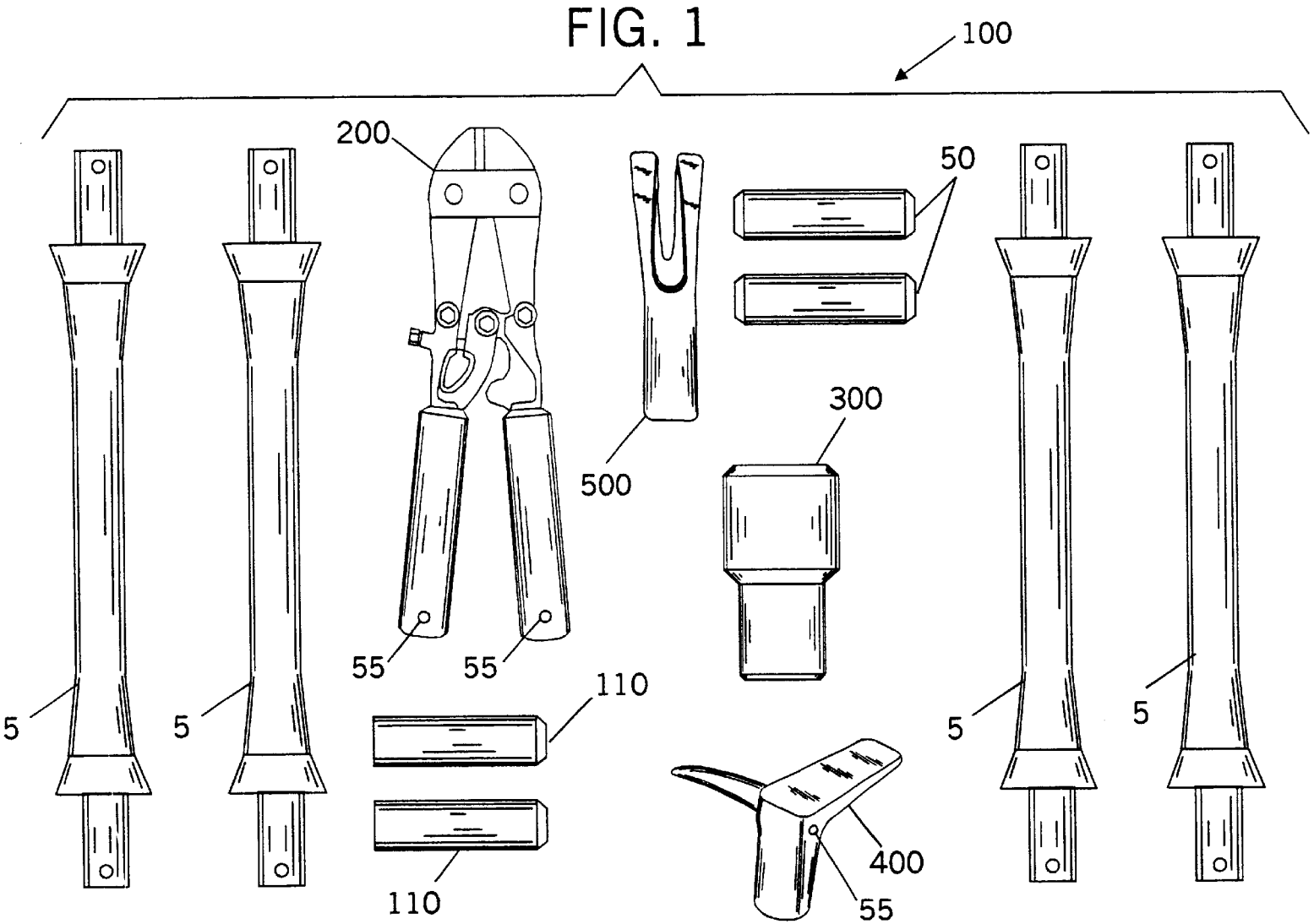
FIG. 1 shows the current invention tool assembly.

FIG. 1 shows an embodiment of the current invention tool assembly (100). This particular embodiment of the tool assembly (100) would be used in military applications which involve breaking into a locked building or enclosure. Similar functions for the tools might be required for a special weapons and tactics squad for a police department or other law enforcement agency. In this particular tool assembly (100), there are four handle assemblies (5) (described in detail in FIGS. 2A, 2B, 2C and 2D). There are two connector sleeves (50) (described in detail in FIG. 3). There are two hand grips (110) (described in FIG. 4). There is one bolt cutter (200) (described in FIGS. 5 and 5A). There is a single headed sledge (300) (described in FIG. 6). There is a hallagan horn (400) (described in FIG. 7) and a hallagan claw (500) (described in FIG. 8).

The handle assembly (5) shown in FIGS. 2A, 2B, 2C, and 2D is an essential part of this invention. The design of the handle assembly (5) is designed to be durable, easy to assembly and disassemble, to provide the greatest safety for a user in dangerous conditions, and to make the assembled tools easy and safe to use.

Figure 2A:
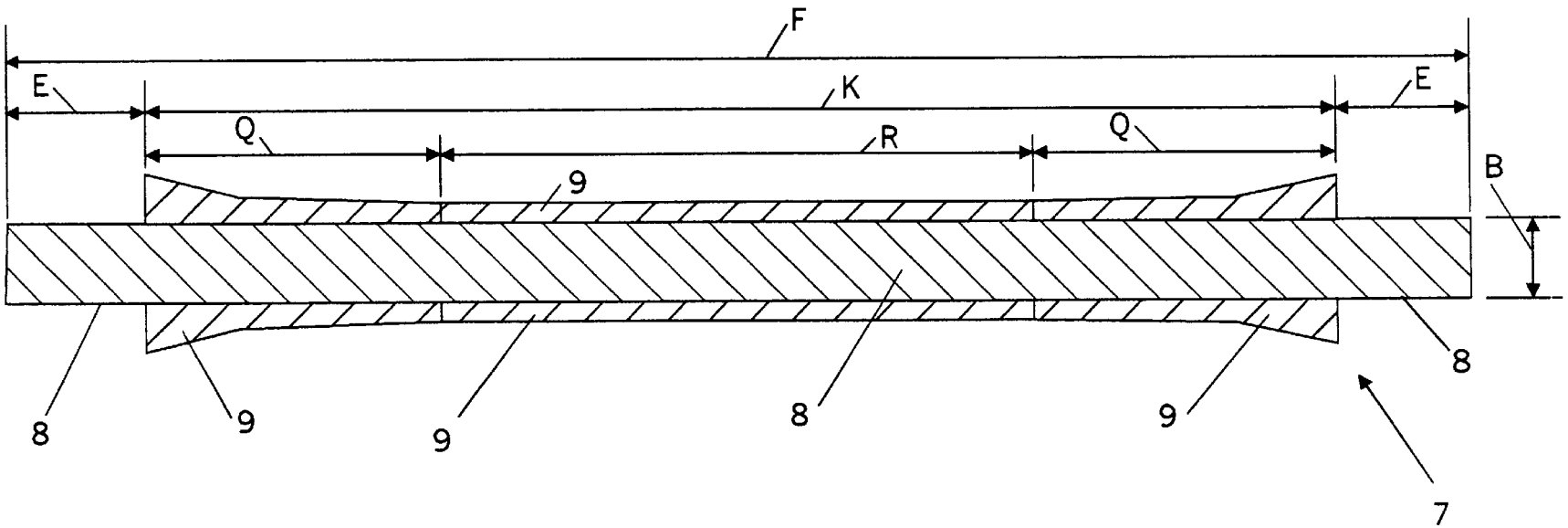
FIGS. 2A, 2B, 2C and 2D show the handle assembly and the connecting apparatus.

FIG. 2A shows a portion of the handle assembly (5) seen in FIG. 1. The tool assembly (100) shown in FIG. 1 will ordinarily have four handle assemblies (5). Seen in FIG. 2A in cut-a-way is the handle rod (7) portion of the handle assembly (5). The handle rod (7) is molded in two pieces. First, there is an inner rigid rod (8). The ends of the rigid rod (8) have a diameter of (B). The rigid rod (8) is ordinarily constructed of some very strong rigid material, preferably a bonded fiber material such as fiberglass or graphite. To facilitate ease of handling and assembly and to reduce the risk of sparking and shock transmission, the rigid rod (8) will ordinarily have an outer covering (9) made of a somewhat softer, tackier material than the rigid rod (7). Polypropylene is one material of choice. The outer covering (9) preferably will often flare at the ends of the handle rod (7). While the outer covering (9) may be circular, it is not necessarily so and preferably is somewhat oblong in a cross section shape, which again facilitates handling and mounting of the tools onto the handle assembly (5). The main length of the handle rod (7) is a distance (F) ordinarily 21 inches. The outer covering (9) extends a centered distance (K) ordinarily 17 inches of the total length. The flared portion of the outer covering (9) extends a distance (Q) 4.25 inches at each end of the outer covering (9). The remaining portion of the outer covering (9) is a length (R) ordinarily 8.5 inches. The handle rod (7) will be permanently bonded to a connector assembly (10) at each end of the handle rod (7) on the rigid rod (8) that is not covered by the outer covering (9) as seen in FIG. 2B.

Figure 2B:
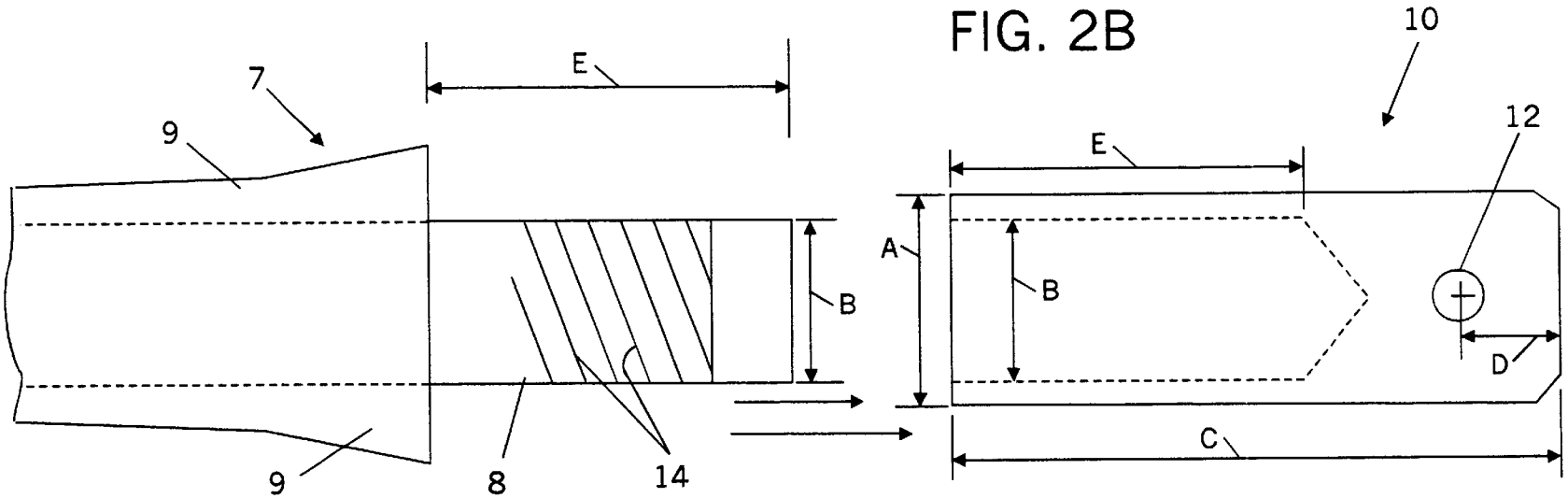

FIG. 2B shows the handle rod (7) and the connector assembly (10) in the process of assembly. The rigid rod (8) with a diameter (B) slides into a bore of the connector assembly (10) having the diameter (B). If the diameter of the handle rod (7) is somewhat larger than the diameter of the bore in the connector assembly (10), the pieces will not fit together hence, cannot be bonded into one piece. However, ideally the diameter of the rigid rod (8) and the bore in the connector assembly (10) will be the same diameter (B). Of course, in practice the diameter of the rigid rod (8) is slightly less than the diameter of the bore in the connector assembly (10). The connector assembly (10) slides onto the rigid rod (8) until it is flush against the outer covering (9). The connector assembly (10) will be glued onto the rigid rod (8) in such a way that the connector assembly (10) is always oriented relative to the outer covering (9) in a particular way. That is to say, on the outer covering (9) there is a flared portion, which is not consistently flared entirely around the circumference of the rigid rod (8). Consequently, the handle assembly (5), unlike a perfect circular handle, will have sides. As long as the connector assembly (10) is always mounted in the same orientation on the handle rod (7), the pin connector (12) will always be oriented on the same side of the handle assembly (5). Because of the differences in the shape of the handle assembly (5), specifically the shape of the outer covering (9), one can determine by feel where the pin connector (12) is oriented. This makes it easier to mount a tool onto the connector assembly (10) in the dark or other bad conditions (this is shown in FIG. 2C). The connector assembly (10) has a length (C) ordinarily 3.5 inches. At an end of the connector assembly (10) distal from the handle rod (7) is a pin connector (12). The pin connector (12) is mounted a definite distance (D) ordinarily 0.75 inches from the end of the connector assembly (10) distal from the handle rod (7). The handle rod assembly (5) has two connector assemblies (10) mounted at each end of the handle assembly (5), as shown in FIG. 1. The connector assembly (10) is mounted on the rigid rod (8) in the exposed portion that is not covered by the outer covering (9). On this exposed portion of the rigid rod (8), a spiral cut (14) is placed to facilitate so that the epoxy or other glue fully penetrates into the rigid rod (8) to complete the bonding to the connector assembly (10). The rigid rod (8) extends a distance of (E) approximately 2 inches into a bore in the connector assembly (10), the bore has at least a depth of (E). Consequently, to mount the connector assembly (10) on the handle rod (7), the length (E) of the rigid rod (8) is coated with a bonding agent such as an epoxy covering the spiral groove (14), then the connector assembly (10) is mated to the rigid rod (8) by sliding the connector assembly (10) onto the exposed length (E) of the rigid rod (8) in a bore having a diameter of (B) and the connector assembly (10). The connector assembly (10) butts up against the outer covering (9). As described above, the connector assembly (10) will be mounted so that the pin connector (12) is always oriented on the same side of the handle assembly (5). At each end of the handle rod (7), connector assemblies (10) are mounted to make a handle assembly (5). The complete handle assembly (5) is preferably 24 inches in total length.

FIG. 2C is an end view of a handle assembly (5). The connector assembly (10) is seen as the circle inside of the oblong outer covering (9). Here, the connector assembly (10) has the diameter (A) of 1.37 inches. The outer covering (9) has a width (Y) of 1.87 inches and a height (X) of 2.55 inches at the point of attachment to the connector assembly (10). As shown in FIG. 2A, the outer covering (9) tapers into the middle of the handle assembly (5). The connector assembly (10) is centered on a mid-line of the width (Y) and the height (X) with the connector pin (12) always oriented so that a line passing through the center of the connector pin (12) would bisect the height (X) of the soft outer covering (9). The utility of this design will be explained later.

Figure 2D:
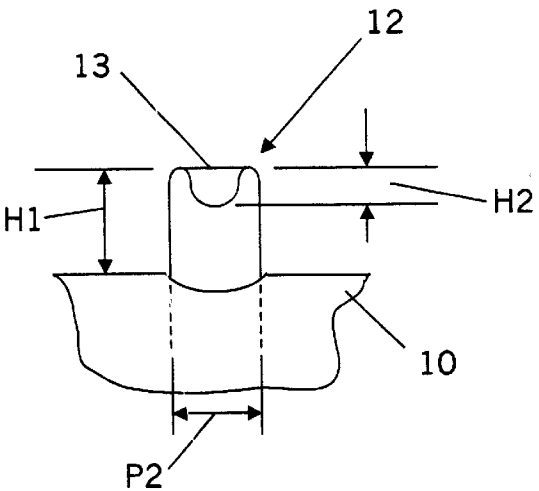
Figure 2C:
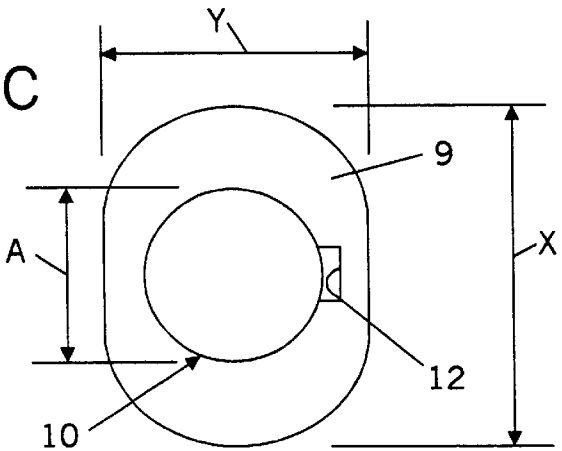

FIG. 2D shows in detail the head of the pin connector (12) on the connector assembly (10). Here, the pin connector (12) has a dimple (13) in the top of the pin connector (12). The dimple (13) is ordinarily 0.094 inches in depth (H2). Ordinarily, connector pins of the type seen in the pin connector (12) have a hemispherical or rounded top. The pin connector (12) is spring-loaded so a force is required to depress the pin connector (12). The pin connector (12) is ordinarily 0.25 inches in height (H1) and 0.25 inches in diameter (P2). To operate the pin connector (12), it must be depressed against the power of the spring (not shown) so that it is flush with the surface of the connector assembly (10). This allows the connector assembly (10) to slide into a bore or female fitting in a tool head, as will be shown in later figures. It can be difficult to depress the pin connector (12) in adverse conditions like darkness or rain, or in a stressful situation such as a fire fight, forcible entry, or the like. The dimple (13) on the pin connector (12) is placed at the top of the pin connector (12) and is designed to readily receive the slug or bullet end of a rifle cartridge. Rifle cartridges are ordinarily available to police or military personnel. Consequently, a user may take a loose cartridge and use the pointed slug or bullet end of the cartridge to depress the pin connector (12) until it is flush with the connector assembly (10) so that it can be easily slid inside a bore or female fitting in a tool head, as is seen in FIGS. 3 and 4.

The connector assembly (10), along with the handle rod (7), is constructed for ease of use in adverse conditions. The design of the outer covering (9), the orientation of the connector assembly (10) on the handle rod (7), and the dimple (13) in the pin connector (12) are all designed to facilitate use of the handle assembly and tool head in darkness, rain, or other difficult conditions. Because the pin connector (12) bisects the height of the outer covering (9), a user can know by feel where the pin connector (12) will be located on the connector assembly (10). A pointed object like the bullet end of a rifle cartridge can be used to depress the pin connector (12) by use of the dimple (13) sliding the appropriate tool head, handle, or connector sleeve onto the connector assembly (10) until the tool head butts up against the outer covering (9). One need only to rotate the tool head on the connector assembly (10) until the pin connector (12) springs into place in the appropriate bore in the tool head. This makes it possible to assemble the tool head in darkness or when the handle assembly (10) and the tool head is out of sight beneath a tarp or other covering. As is described later in this application the preferred nylon material for the connector assembly (10) does not clink or rattle against the tool head. The outer covering (9) on the handle assembly (5) is non-sparking and non-conductive. The flared portion of the outer covering (9) on the tool handle, as well as the tapering part of the outer covering (9), make it possible to know by feel where one is gripping the handle assembly (5) without being able to see it. These design features of a handle assembly (5) are desirable in any application but are particularly important or even essential in military applications, drug enforcement applications, or special weapons and tactics police squad applications. Under these circumstances, users of the handle assembly (5) will be required to assemble them as quietly and quickly as possible, frequently in the dark. The handle assembly (5) and tool head may have been carried for miles in the dark, immersed in water and in mud, and then must be assembled in the dark without time for cleaning or drying. Again, the particular materials used, the design of the connector assembly (10) including the pin connector (12) and dimple (13), the appropriate tolerances in the bores in the tool head handle and connector sleeves are all ideally designed to reach the perfect balance between ease of assembly, silence of assembly, safety of assembly, with the need for structural integrity of the tool once assembled.

The embodiment of the tool assembly (100) shown in FIG. 1 is designed primarily for breaching or forcible entries. This means the handle assembly and tool head are used for prying, smashing, picking, or cutting. This places a high degree of stress on the entire tool, but particularly on the points of connection of the handle assembly (5) with tool heads. Consequently, the connector assembly (10), which is used to connect the handle assembly (5) to a tool head, must carefully and closely fit within a female fitting on one of the tool heads, such as the hallagan horn, spike, or bolt cutter shown in FIGS. 5, 6, 7, and 8. This has important consequences for design of the tool assembly (10). First, the connector assembly (10) must be constructed of non-corroding materials. Corrosion with either the connector assembly (10) or the tool head might make it impossible to mount the tool head using the connector assembly (10). Consequently, the connector assembly should ideally be constructed of some rigid durable material which is easily cleaned and which is self-lubricating.

Figure 3:
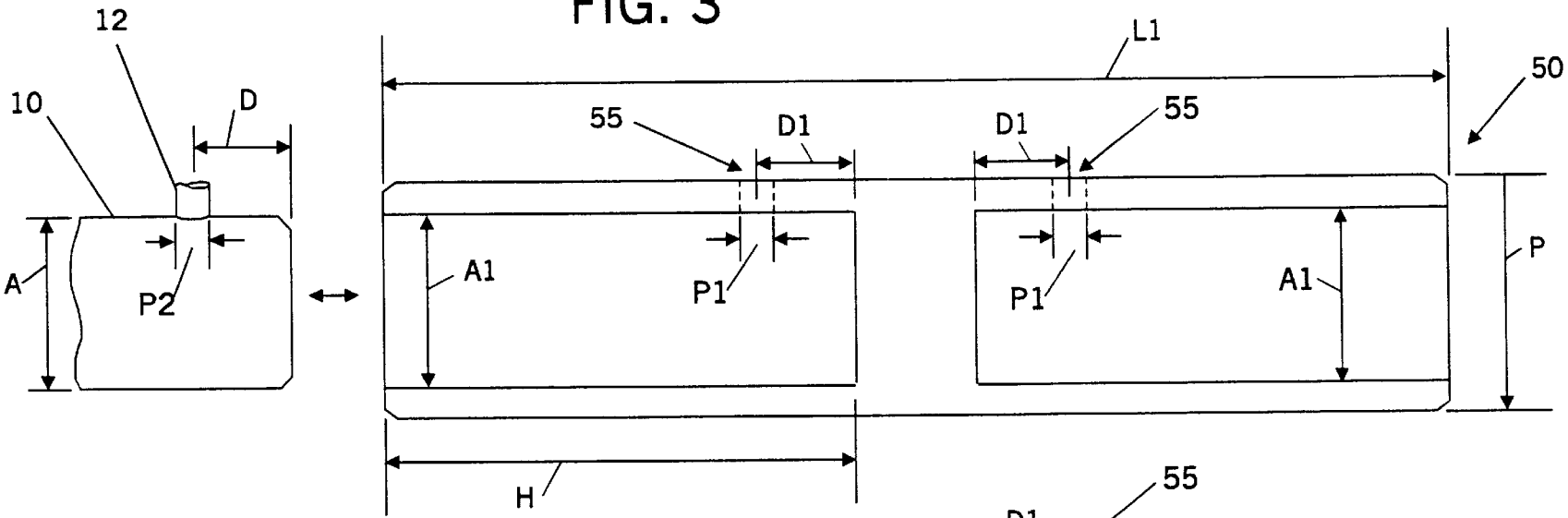
FIG. 3 shows a connector sleeve.
Figure 4:
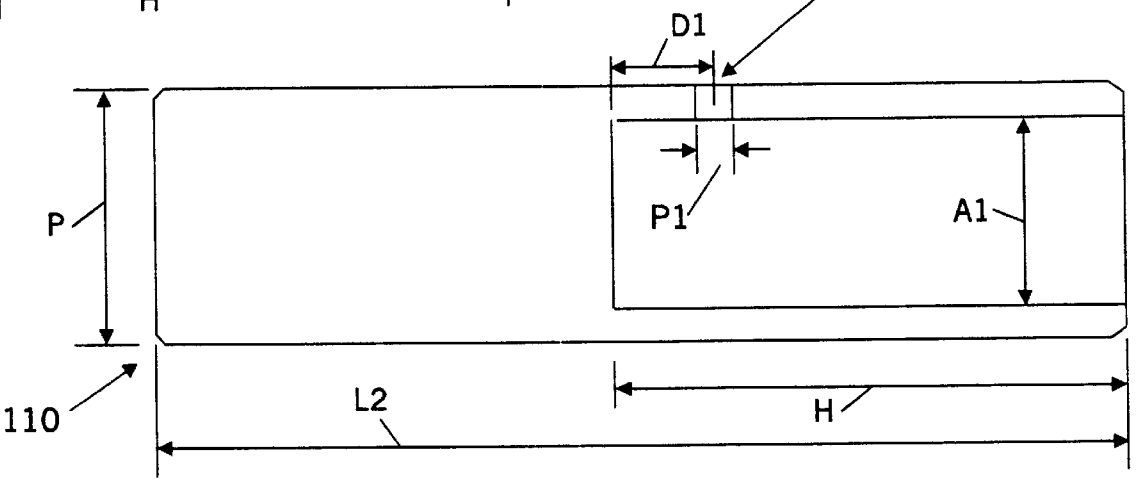
FIG. 4 shows a hand grip.

FIG. 3 shows a connector sleeve (50) cut-a-way. A connector sleeve (50) is used to connect two handle assemblies (5) into paired handle assemblage that is at least twice the length of each individual handle assembly (5). FIG. 3, while showing the connector sleeve (50), also shows how the connector assembly (10) is used to attach the handle assembly (5) to any other tool of the tool assembly (100). The connector assembly (10) slides as a male fitting into the bore in a female fitting formed an end of the connector sleeve (50). The connector assembly (10) has a diameter of (A) 1.37 inches. The connector sleeve (50) and every other part of the tool assembly (100) has a female fitting for receipt of the connector assembly (10) with a bore (A1) with a diameter 1.385 inches and a length of (H) 3.480 inches. This is a close tolerance. The bore (A1) in the female fitting in all tools in the tool assembly (100) in which the connector assembly (10) must slide is only $^{15}/_{1000}$ of an inch larger in diameter than the diameter of the connector assembly (10). Although somewhat larger tolerances may be permitted, the bore (A1) should be no more than $^{30}/_{1000}$ larger in diameter than the diameter (A) of the connector assembly (10). The pin connector (12) is depressed using the dimple (13) to allow the connector assembly (10) to slide into the bore (A1). A pin connector hole (55) is drilled in the female fitting so that the pin connector (12) can pop into place securing the connector assembly (10) of the handle assembly (5) in place. The pin connector (12) is a distance (D) 0.75 inches from an end of the handle of the handle assembly (5). The pin connector hole (55) is placed a distance (D1) 0.755 inches from the end of the bore in the female fitting. Again, the tolerances are quite close with only $^{5}/_{1000}$ of an inch tolerance provided. The pin connector hole (55) has a diameter (P1) of 0.265 inches. Finding the appropriate tolerances is important for the overall functioning of the tool assembly (100). If the tolerances are too small, then grit, dirt, grime, and the like can make it impossible to assemble the tool assembly (100) using the connector assembly (10) with the corresponding female fittings. If, on the other hand, the tolerances are too large, it will add points of stress, hence points of possible failure, at the points of connection when the tool assembly is in use. The closer the tolerances, the more the assembled tool will act like a one-piece tool rather than a tool assembled from pieces. Moreover, in the particular applications envisioned for this tool assembly of military or military-like uses, it is necessary that the tool assembly be easy to operate and quickly assembled. Therefore, threaded connectors are impractical. It takes too long to thread a male piece into a female piece. Moreover, if the threads are fouled or dirty, they may not fit together at all. It can be difficult to start a threaded piece in adverse conditions such as rain or darkness.

These requirements mean that many materials that might ordinarily be used for tools are unsuitable for this particular invention. For example, any material that rusts, corrodes, or collects dirt is unsuitable for use in a connector assembly (10) or in any kind of female fitting like that shown for the connector sleeve (50). It has been found that the connector assembly (10) is best constructed of material like nylon or a composite material which may be impregnated with a dry lubricant. One type of material which has been found to operate well in this context is a monocast nylon impregnated with finely divided particles of molybdenum disulfide solid lubricant dispersed through the monocast nylon. The molybdenum disulfide provides extra surface lubrication. Moreover, the monocast nylon is non-galling and non-scratching, is resistant to oils, greases, and most alkalis, solvents, and organic acids. The nylon also does not clink or make sounds like metal, which, again, is important in military applications where the element of surprise is frequently important. This type of nylon is non-conductive with good tensile strength, elasticity, and shear strength. This type of nylon is sold under the brand name of Nylatron®. By the same token, the connector sleeve (50), the handle grips (110) (seen in FIG. 3), and the bolt cutter handle (210) (seen in FIG. 5) are also constructed of a monocast nylon material which is self-lubricating.

There is a bore (A1) at each end of the connector sleeve (50). The connector sleeve (50) has an overall length (L1) ordinarily 7.5 inches. This allows two handle assemblies (5) to fit into the respective bores at each end of the connector sleeve (50). The bore (A1) is 1.385 inches, while the overall diameter (P) of the connector sleeve (50) is 1.75 inches. While the monocast nylon material that the connector sleeve (50) is ordinarily constructed of has good tensile strength, elasticity, and shear strength, the amount of material that surrounds the bore is necessarily somewhat small—here, just a little over a third of an inch. This is not enough material to allow two handle assemblies (5) to be connected using the connector sleeve (50) and to be used under heavy loading conditions such as use as a pry bar or so on. For use in extreme conditions, the tool assembly (100) may be sold without the connector sleeves (50). If a connector sleeve (50) is used to connect two or more handle assemblies for connection to a tool head like a hallagan claw (seen in FIG. 7) or a bolt cutter (seen in FIG. 4), so much pressure can be applied by a user to the overall tool assembly that failure is possible either at the connector sleeves (50) or where the handle assembly (5) connects to a particular tool head, be it a bolt cutter (200), a hallagan claw (500), or a hallagan spike (400).

FIG. 4 shows a hand grip (110). A hand grip (110) connects to a handle assembly (5) by means of the connector assembly (10). As with the connector sleeve (50) shown in FIG. 3, the hand grip (110) has female fitting with a bore (A1) with a diameter of 1.385 inches and a length of (H) 3.480 inches. A pin connector hole (55) is drilled for receipt of the pin connector (12) and has a diameter (P1) of 0.265 inches. The pin connector hole (55), as in the connector sleeve (50), is drilled a distance (D1) 0.755 inches from the end of the bore (A1) in the hand grip (110). It will be noted that the hand grip (110) and the connector sleeve (50) have uniform measurements for receipt of the connector assembly (10) on the handle assembly (5). Ordinarily two hand grips (110) will be provided in the tool assembly (110) as shown in FIG. 1. The hand grip (110) has an overall length (L2) of 5.5 inches and a diameter (P) of 1.75 inches. One or more hand grips (110) will be used to complete a tool assembled from the various parts.

Figure 5:
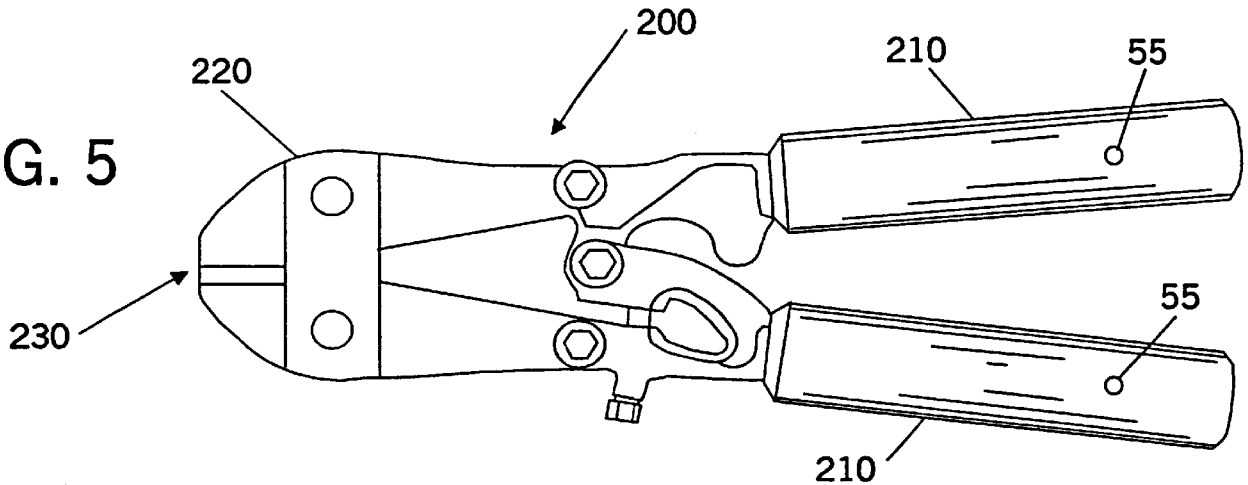
FIGS. 5 and 5A show a bolt cutter in detail.
Figure 5A:
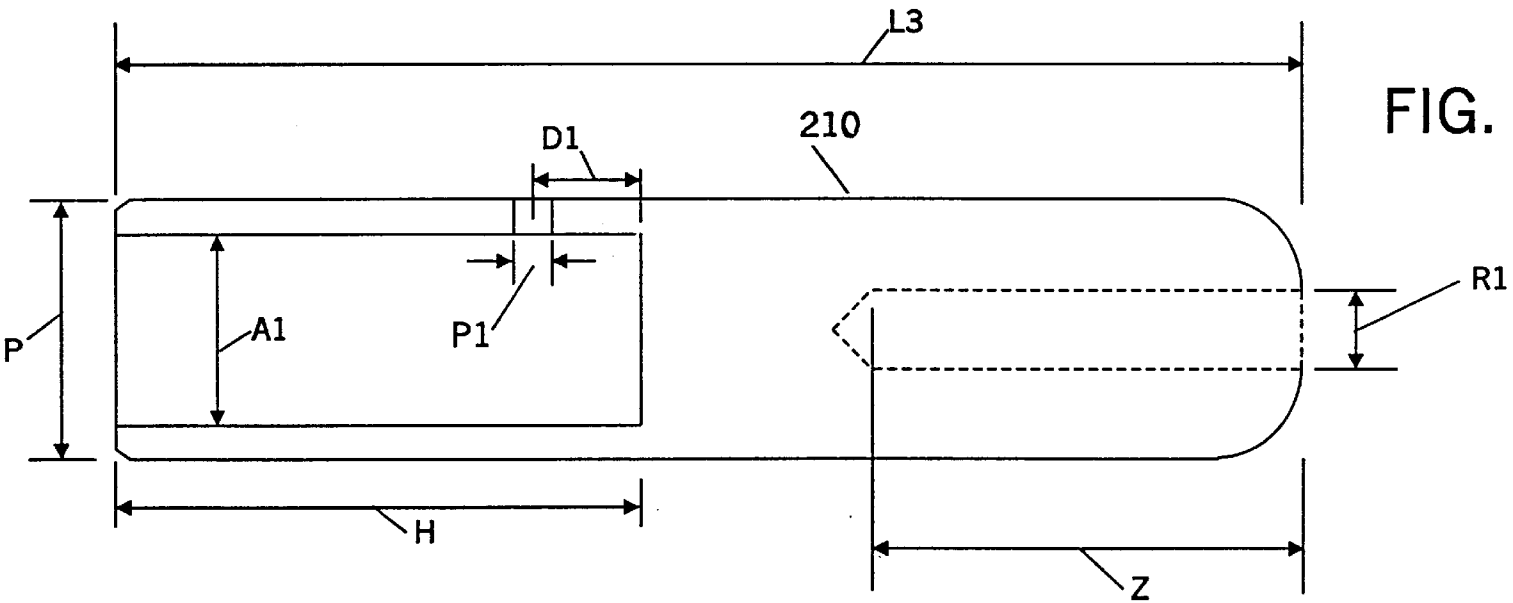

FIGS. 5 and 5A show respectively a bolt cutter (200) and the bolt cutter handle (210) shown in cut-a-way. The bolt cutter handles (210) are made of a cast nylon material with an embedded solid lubricant, as was described for the connector sleeve (50), the hand grip (110), and the connector assembly (10). The bolt cutter head (220) is a standard design. The bolt cutter handles (210) are used to open and close the cutting jaws (230) to cut such things as padlocks, bolts, or other pieces of metal. The design of the bolt cutter (200) provides a mechanical advantage to increase the shearing power of the cutting jaws (230). However, the handle assemblies (5) may be connected to the bolt cutter handles (210) to effectively increase the length of the bolt cutter handles (210) thus, increasing the leverage possible to be applied by an operator gripping the handle assemblies (5) at the end distal to the attachment to the bolt cutter handles (210). Hand grips (110) will be attached to connector assemblies (10) on the handle assemblies (5) at the ends of the handle assemblies (5) distal from the points of connection of the handle assemblies (5) to the bolt cutter handles (210).

FIG. 5A shows in cut-a-way how the bolt cutter handles (210) are attached to the bolt cutter (200). As with the hand grips (110) and connector sleeves (50), the connector assembly (10) on the handle assembly (5) slides into a bore (A1) having a diameter of 1.385 inches on the bolt cutter handle (210). The bolt cutter handle (210) bore has a length of (H) 3.480 inches. The bolt cutter handle (210) itself has a length of (L3) 7.5 inches. To secure the bolt cutter (200) to the bolt cutter handle (210), a bore (R1) is cut into the bolt cutter handle (210) opposite from the bore that receives the connector assembly (10) on the handle assembly (5). This bore (R) has a diameter of 0.75 inches and a length (X) of 3.125 inches and receievs a tang. The bolt cutter handle (210) has a diameter of (P) 1.75 inches. As with the other connector pieces, the bolt cutter handle (210) is made of a cast nylon impregnated with a dry lubricant. The advantages of this kind of cast nylon material was discussed when describing the connector sleeves (50).

Figure 8:
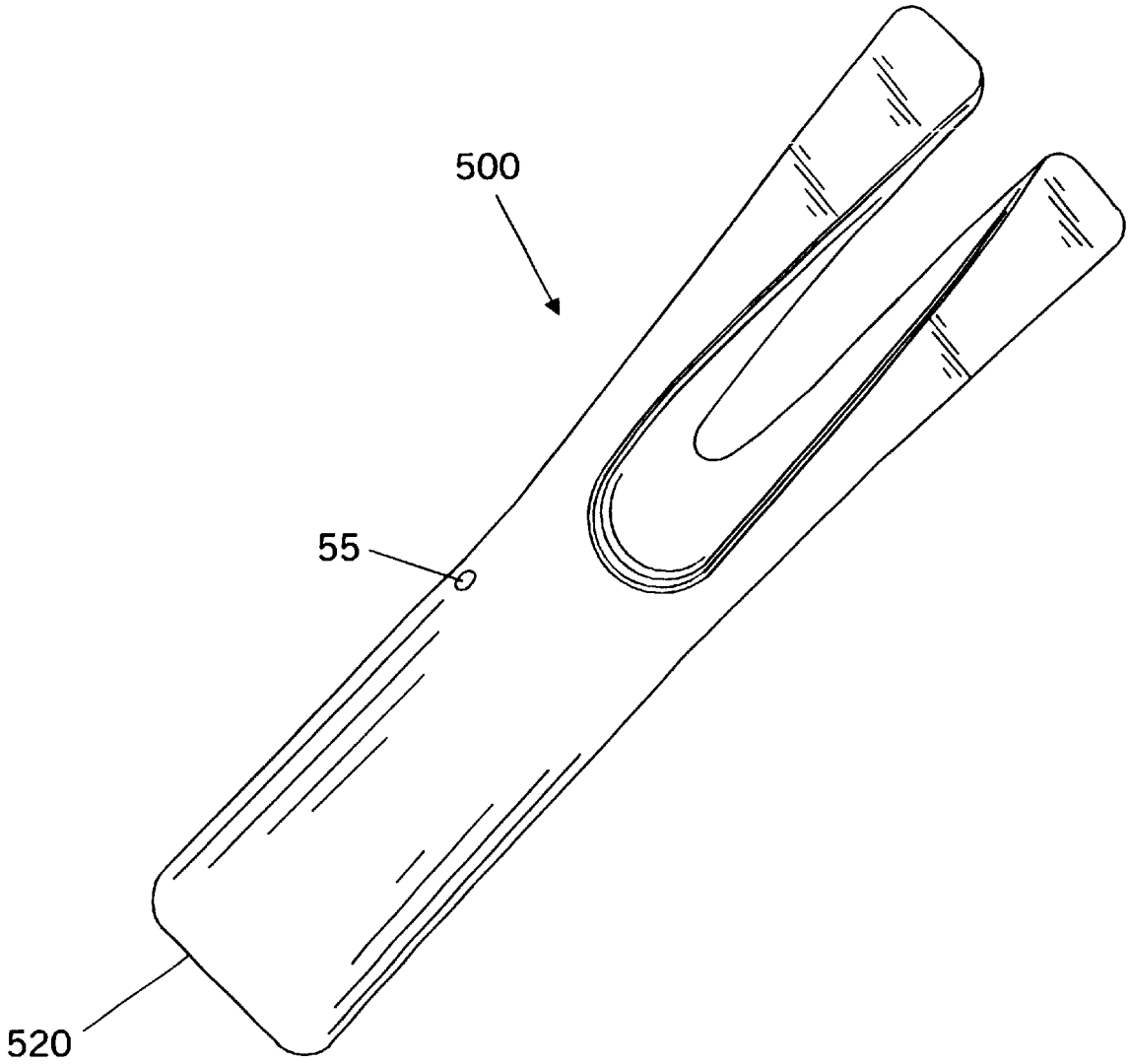
FIG. 8 shows a hallagan claw.

FIGS. 6, 7, and 8 show tools which can be attached to the handle assembly (5) by means of the connector assembly (10). FIG. 5 shows a single headed sledge (300). The sledge (300) has a blunt end (310) which can be used for pounding or battering. Opposite from the blunt end (310) on the sledge (300) a female fitting with bore (320) is drilled. The bore (320) is of the same dimensions for receipt of the handle assembly (5) and connector assembly (10) and has been shown in the drawings for the connector sleeve (50), the hand grip (110), and the bolt cutter handle (210). That is, a handle assembly (5) will be inserted into the bore (320) with a pin connector (12) depressed until the pin connector (12) aligns with the pin connector hole (55) placed appropriately on the sledge (300). Ordinarily, with this particular tool assembly (100) two further tool heads will be furnished. FIG. 6 shows a tool commonly called a hallagan horn. This is used for prying or for picking. The hallagan horn (400) also has a bore (420) and a pin connector hole (55) again, for connection of the handle assembly (5) through the connector assembly (10). The sledge (300), the hallagan horn (400), and the hallagan claw (500) (shown in FIG. 7) are preferably constructed of dense strong alloys. FIG. 7 shows a hallagan claw (500) and a bore (520) and a pin connector hole (55), which connects to the handle assembly (5) through the connector assembly (10), as has been previously described. For applications requiring non-sparking tool heads, the preferred head material is a zinc-aluminum alloy. Because of the aluminum in the zinc alloy, a cold chamber die-casting process is most efficient for making these tool heads. This zinc-aluminum alloy has greater impact resistance than cast aluminum, plastics, or gray cast iron. Also, zinc-aluminum alloy may be precision cast which is important for the close tolerances required for the proper operation of these tools. Moreover, zinc alloys are non-sparking and are suitable for use in locations where volatile or explosive gases may be present. The zinc-aluminum alloy of choice is commonly called ZA12. For other applications, stainless steel will be used for the tool heads like the hallagan horn (400), the hallagan claw (500), and the sledge (300).

Typically, a tool assembly (100) will be equipped with four tool handle assemblies (5), two connector sleeves (50), one hallagan spike end (400), one hallagan claw end (500), one sledge (300), one bolt cutter (200), two hand grips (110), as well as a carrying kit or bag. However, it will be readily appreciated by one of skill in the art, additional tool heads could be provided or substituted. The particular tools chosen and illustrated here are primarily used for breaching operations—that is, breaking into or prying open locked enclosures. However, one could easily provide a shovel head of various shapes should digging be the proposed use of a tool assembly (100). Under this system, any tool can be exchanged with any handle hence, even if specific handles are missing or damaged, a tool may be assembled from other handles. The male and female ends of the tools are designed so the tools can be exchanged within a particular set of tools. The tools are easily broken down into their component parts where the longest part is the 24-inch handle. The use of the hand grips (110) and of the couplers (50) enable the tools to be assembled into larger units. The use of non-corrosive materials like cast nylon, zinc alloy, and stainless steel assure the interchangeability of the handles and tool heads in adverse conditions.

I claim:

1. A combination tool assembly comprising:

(a) at least one handle of a definite width and height in cross-section made of non-conductive material, said at least one handle having a length between 22 to 26 inches;

(b) for said at least one handle, a generally tubular connector assembly made of a non-conductive non-corroding material impregnated with a dry lubricant and located at a first end and a second end of said at least one handle, said generally tubular connector assembly having a diameter no less than 1.37 inches and no more than 1.39 inches:

() at least one tool head having at least one receiver bore, said at least one receiver bore having a diameter at least as large as said connector assembly's diameter but no more than 0.030 inches larger than said diameter of said connector assembly;

(d) on said connector assembly a dimpled pin connector approximately 0.25 inches in height and a proximately 0.25 inches in width said dim led in connector mounted no less than 0.74 inches and no more than 0.76 inches from an end of said connector assembly; (e) in said tool head a push pin bore greater than 0.25 inches width but no more than 0.01 inches in width than said pin connector's width and said push pin bore mounted no less than 0.740 inches and no more than 0.765 inches from an end of said receiver bore whereby said at least one tool head may be removably secured to said at least one handle and a user of said at least one handle may determine the orientation of said pin connector by feel and dimpled pin connector facilitates depressing said pin connector providing versatility and ease of assembly of components into a completed tool.

2. A combination tool assembly of claim 1 wherein said combination tool assembly consists of at least two handles and at least two tool heads.

3. A combination tool assembly of claim 2 wherein said receiver bore in each of said at least two tool heads is lined with a non-corroding material.

4. A combination tool assembly of claim 3 wherein said combination tool assembly further comprises at least two grips, said grips made of non-conductive material, each of said grips having at least one of said receiver bores whereby said grips may be removably secured onto said connector assembly on said at least one handle.

5. A combination tool assembly of claim 4 wherein at least a portion each of said at least two handles is made of a soft, shock absorbing, non-conductive, non-sparking material.

6. A combination tool assembly of claim 5 wherein said at least two tool heads are constructed of a non-corroding material.

7. A combination tool assembly comprising:

(a) at least two handles of non-conductive material, said at least two handles having a length of approximately 24 inches each, at ends of said at least two handles generally tubular connector assembly, said connector assemblies are made of a non-conductive, non-corroding materials impregnated with a dry lubricant and having a diameter of approximately 1.37 inches;

(b) at least two tool heads, each of said at least two tool heads having at least one receiver bore with said at least one receiver bore having a diameter at least as large as said diameter of said connector assembly but no more than 0.03 inches larger than said diameter of said connector assembly:

(c) on each connector assembly approximately 0.75 inches from an end of said connector assembly a dimpled pin connector approximately 0.25 inches in height and approximately 0.25 inches in width and in each of said at least two tool heads a pin connector bore said pin connector bore mounted approximately 0.755 inches from an end of said at least one receiver bore for receipt of said dimpled pin connector, said pin connector bore having a width greater than said width of said pin connector but no more than 0.01 inches greater in width than said width of said pin connector:

(d) at least a portion of each of said at least two handles is made at least in part of a soft shock absorbing, non-conductive, non-sparking material having a definite width and height in cross-section and said dimpled pin connector is in a definite orientation relative to said width and height;

whereby said tool head may be removably secured to said handle by depressing said pin connector on said connector assembly, sliding said connector assembly into said receiver bore, and maneuvering said handle until said pin connector snaps into place into said pin connector bore using said width and height to determine orientation of said dimpled pin connector.

8. A combination tool assembly of claim 7 wherein said at least one receiver bore in said at least two tool head is lined with a non-corroding material.

9. A combination tool assembly of claim 8 wherein said combination tool assembly further comprises at least two grips, said grips made of non-conductive material, each of said at least two grips having a second receiver bore whereby said grip may be removably secured onto said connector assembly on said at least two handles.

10. A combination tool assembly of claim 9 wherein said at least two tool heads are constructed of a non-sparking, non-conducting material.

11. A combination tool assembly of claim 10 wherein said at least two grips are made of a non-conductive, non-corroding material impregnated with a dry lubricant.

* * * * *